US005296059A

United States Patent [19]

Masumoto et al.

[11] Patent Number: 5,296,059

[45] Date of Patent: Mar. 22, 1994

[54] PROCESS FOR PRODUCING AMORPHOUS ALLOY MATERIAL

[75] Inventors: Tsuyoshi Masumoto, 3-8-22, Kamisugi, Aoba-ku, Sendai-shi, Miyagi; Akihisa Inoue, 11-806, Kawauchijutaku, Mubanchi, Kawauchi, Aoba-ku, Sendai-shi, Miyagi; Junichi Nagahora, Yokohama; Kazuhiko Kita, Uozu, all of Japan

[73] Assignees: Tsuyoshi Masumoto; Akihisa Inoue, both of Miyagi; Yoshida Kogyo K.K., Tokyo, all of Japan

[21] Appl. No.: 943,703

[22] Filed: Sep. 11, 1992

[30] Foreign Application Priority Data

Sep. 13, 1991 [JP] Japan ..... 3-234801

[51] Int. Cl.[5] ..... C22F 1/04

[52] U.S. Cl. ..... 148/695; 148/564; 148/667; 148/668; 148/672; 148/403; 148/420; 148/437; 148/439

[58] Field of Search ..... 148/695, 564, 667, 668, 148/672, 403, 420, 437, 439; 420/902

[56] References Cited

U.S. PATENT DOCUMENTS 5,074,935 12/1991 Masumoto et al. ..... 148/403

FOREIGN PATENT DOCUMENTS 0318875 6/1989 European Pat. Off. .
0494688 7/1992 European Pat. Off. .
0517094 12/1992 European Pat. Off. .

*Primary Examiner*—R. Dean
*Assistant Examiner*—Robert R. Koehler
*Attorney, Agent, or Firm*—Flynn, Thiel, Boutell & Tanis

[57] ABSTRACT

A process for producing an amorphous alloy material characterized by imparting ductility to an amorphous alloy having a supercooled liquid region by giving a prescribed amount of strain at a prescribed strain rate to the alloy in the glass transition temperature region of the alloy. The amorphous alloy may be in the form of spherical or irregular-shaped powders or thin ribbons or in the form of primary consolidated shapes thereof or an amorphous alloy casting. The amount of strain and strain rate are preferably 50% or greater and $2\times10^{-2}$/sec or higher, respectively, and the worked amorphous alloy material is preferably allowed to cool in a furnace or spontaneously. Suitable examples of the amorphous alloy to be employed include Al-TM-Ln, Mg-TM-Ln, Zr-TM-Al and Hf-TM-Al alloys, wherein TM is a transition metal element and Ln is a rare earth metal element. The thus obtained amorphous alloy is greatly improved in the prevention of embrittlement in hot working peculiar to the alloy.

18 Claims, 2 Drawing Sheets

PROCESS FOR PRODUCING AMORPHOUS ALLOY MATERIAL

BACKGROUND OF THE INVENTION

1. Field of the Invention

The present invention relates to a process for producing an amorphous alloy material which is improved in the prevention of embrittlement peculiar to an amorphous alloy when the amorphous alloy material is subjected to a prolonged thermal history in a high-temperature working.

2. Description of the Prior Art

The present inventors invented an Al-TM-Ln alloy and Mg-TM-Ln alloy (wherein TM is a transition metal element or the like and Ln is a rare earth metal element or the like) as light-weight high-strength amorphous alloys and applied for a patent as disclosed in Japanese Patent Laid-Open Nos. 275732/1989 and 10041/1991, respectively. In addition, they also invented an Al-TM-Ln alloy and a Zr-TM-Al alloy as high-strength amorphous alloys having excellent workability and applied for a patent as disclosed in Japanese Patent Laid-Open Nos. 36243/1991 and 158446/1991, respectively.

Having high strength and high corrosion resistance, each of the above alloys shows glass transition behavior and possesses a supercooled liquid region, and therefore exhibits favorable workability at a temperature within or around the above region. Moreover, the above alloys that are obtained as powder or thin ribbon can be easily subjected to consolidation forming, and further made into amorphous bulk materials by casting, and are also excellent alloys exhibiting favorable workability at a temperature within or around the supercooled liquid region.

However, when the amorphous alloy is held in the above-mentioned supercooled liquid region for a long time, it begins to be transformed to its crystalline form, thus restricting the time for working such as consolidation forming and work forming. As the countermeasure against the restriction, there is available a method in which consolidation forming and work forming are carried out at the glass transition temperature or lower. As is the case with the general amorphous alloys, the aforestated alloy, when heated to a temperature immediately below the glass transition temperature, suddenly loses the ductility peculiar to the amorphous alloys and is inevitably embrittled. Accordingly, the amorphous alloy subjected to consolidation forming or rework forming at a high temperature still involves the problem of failure to sufficiently exhibit the inherent characteristics thereof.

The present inventors have found that the ductility of the alloy is restored by a two-step treatment which comprises holding the alloy in the supercooled liquid region (glass transition temperature region) after working immediately below the glass transition temperature and subsequently quenching the alloy for the purpose of solving the above-mentioned problem, and applied for a patent on the basis of the aforesaid finding. Thereafter, they have further found out a method which can dispense with the quenching after the second stage heat treatment. The present invention has been accomplished on the basis of the above finding.

It has already been known that in general an amorphous alloy is embrittled when heated to a high temperature around the glass transition temperature thereof even if the temperature is lower than the crystallization temperature thereof.

The above phenomenon is attributable to the structural change into a more stable atomic arrangement in spite of its amorphousness and generally relates to structural relaxation. In the above structural relaxation a reversible reaction and an irreversible reaction are mixed with each other, of which the reversible reaction is cancelled by rapid heating to a high temperature. However, the abovementioned phenomenon takes place in an extremely short time and successively brings about further structural relaxation at another temperature. Consequently it is impossible to prevent the structural relaxation of an amorphous alloy by reheating alone, thus making it difficult to avoid such structural relaxation.

SUMMARY OF THE INVENTION

It is an object of the present invention to prevent an amorphous alloy from being embrittled and provide a process for the consolidation forming or work forming of an amorphous alloy in the form of powder in different shapes or thin ribbons or an amorphous bulk material obtained by casting without the loss of the characteristics inherent in the alloy, such as ductility.

The present invention relates to a process for producing an amorphous alloy material which comprises imparting ductility to an amorphous alloy having a supercooled liquid region by giving a prescribed amount of strain at a prescribed strain rate to the alloy in the glass transition temperature region of the alloy.

The present invention further relates to a process for producing an amorphous alloy material which comprises producing a ductile consolidated shape by giving a prescribed amount of strain at a prescribed strain rate to an amorphous alloy in the form of spherical or irregular-shaped powder or thin ribbon while pressing in the glass transition temperature region of said alloy.

In the present invention, there is sometimes employed a casting or a primary consolidated material of powder or thin ribbons.

The preferable conditions in any case include a prescribed strain rate of $2\times10^{-2}$/sec or higher and a prescribed amount of strain of 50% or greater.

It is preferable to allow the worked alloy material to cool in a furnace or spontaneously at a cooling rate of 5° C./min.

Suitable examples of the amorphous alloy to be employed include Al-TM-Ln, Mg-TM-Ln, Zr-TM-Al and Hf-TM-Al alloys, wherein TM is a transition metal element and Ln is a rare earth metal element.

DETAILED DESCRIPTION OF THE PREFERRED EMBODIMENTS

Figure 1:
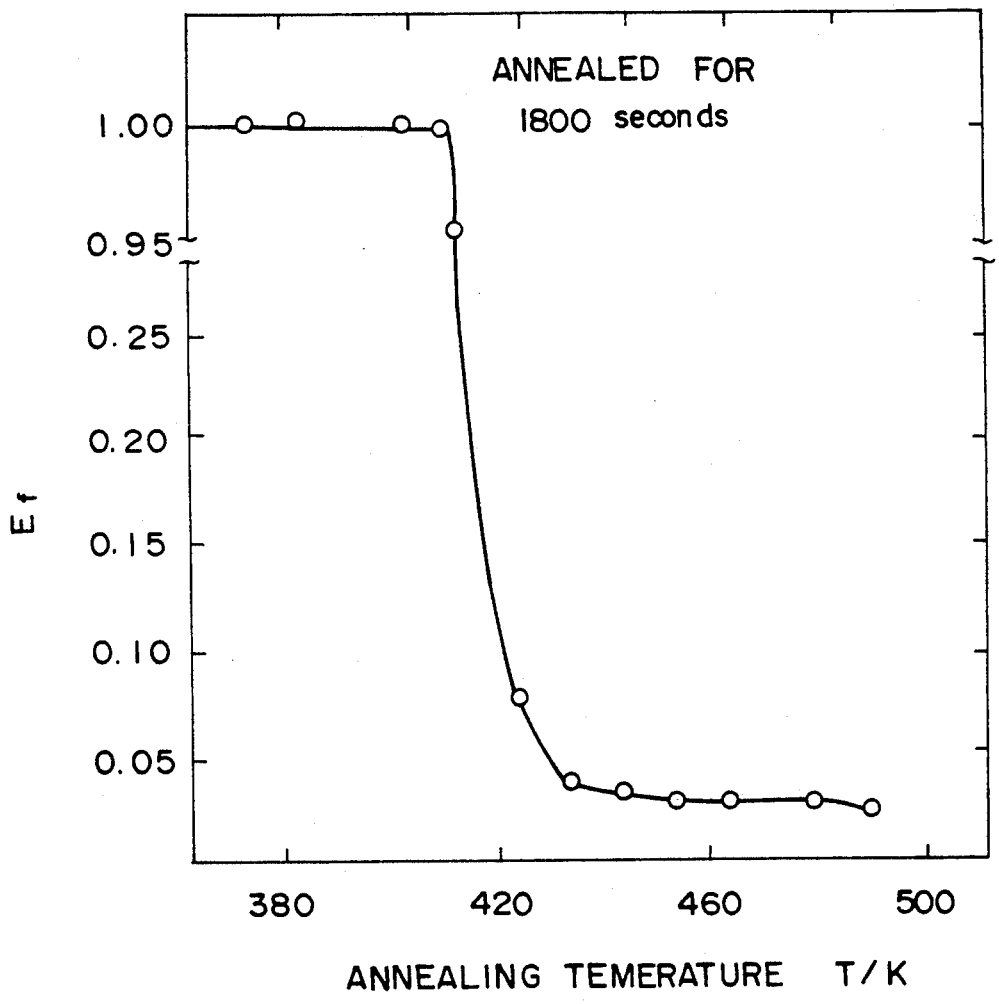
FIG. 1 is a graph showing the measurement results for the ductility of an amorphous ribbon.

The aforestated amorphous alloy is obtained by the well-known quenching solidification method, such as melt spinning, in-rotating-water melt-spinning or gas atomizing.

The amorphous alloy obtained by any of the abovementioned methods is transformed into a crystalline structure by heating.

By the term "glass transition temperature (Tg)" is meant the starting point of an endothermic peak which appears prior to crystallization in a differential scanning calorimetric curve obtained at a heating rate of 40° C./min. By the term "crystallization temperature (Tx)" is meant the starting point of the first exothermic peak in a differential scanning calorimetric curve. "Supercooled liquid region" covers the region in the range of the glass transition temperature to the cryslallization temperature. The glass transition temperature and crystallization temperature vary depending on alloy species and alloy composition.

It is known as a general rule that although an amorphous alloy remains amorphous when heated to the glass transition temperature or lower, it undergoes a structural change into a more stable atomic arrangement, thus causing the so-called structural relaxation. It is explained as the phenomenon in which an amorphous alloy release, when heated, part of the free volume introduced thereinto in the production thereof accompanied by a slight increase in density. Some reports suggest that the aforesaid structural relaxation is a reversible reaction and cancelled by heating to a higher temperature. However, the heating is practically restricted in that it is effective only for the structural relaxation at a relatively lower temperature and that it should be carried out for a short holding time under precisely controlled heat treatment conditions. The amorphous alloy loses the ductility peculiar to itself to cause embrittlement by the structural relaxation and, once subjected to thermal embrittlement, it cannot sufficiently exhibit its characteristics in practical application.

In the supercooled liquid region, an amorphous alloy behaves as if it were a liquid owing to the extremely high diffusion rate of the alloying elements, and therefore the amorphous alloy material undergoes a large, .deformation even at a low stress, thus making itself available for consolidation forming or plastic working of the alloy powder. Nevertheless, the above process can never be an optimum production process in practical application, since the working time is greatly limited to prevent crystallization in the region and at the same time strict control is required for temperature, etc.

In view of the foregoing, it is suggested that an amorphous alloy material be worked at the glass transition temperature or lower. The above process can mitigate the restriction of the production condition with regard to crystallization, but brings about practically unsuitable embrittlement due to the above-mentioned structural relaxation.

Japanese Patent Application No. 18207/1991 filed by the present inventors describes that the embrittlement of an amorphous alloy caused by the working thereof at the glass transition temperature or lower can be cancelled by the combined utilization of the behavior at the glass transition temperature or lower with the properties in the supercooled liquid region. Specifically, the amorphous alloy is subjected to the first-stage heat treatment wherein the alloy is held at the glass transition temperature or lower and/or worked by consolidation forming or other method, whereby the alloy undergoes embrittlement due to structural relaxation. Then,-the alloy is subjected to the second-stage heat treatment wherein the alloy is heated to a temperature in the supercooled liquid region and held thereat for a prescribed time, whereby the structural relaxation caused in the first stage disappears into the supercooled liquid. Thereafter,the alloy in the supercooled region is quenched to room temperature by a suitable method such as water cooling, whereby the supercooled liquid structure is fixed as such at room temperature and the ductility of the alloy is restored.

The process of the present invention can be attained by subjecting an amorphous alloy to plastic working at a temperature in the supercooled liquid region by taking advantage of the easy workability in the region as it is, giving a prescribed amount of strain at a prescribed strain rate to the alloy and, preferably) gradually cooling the alloy (in a furnace or spontaneously) from the working temperature. More specifically, an amorphous alloy having a supercooled liquid region is heated to a temperature in that region, given a strain in an amount of not less than 50% at a strain rate of not lower than $2\times10^{-2}$/sec and, preferably, subsequently allowed to cool in a furnace or spontaneously in the working equipment so as to enable the production of the amorphous alloy material having excellent ductility. It is important to work the alloy at a temperature in the supercooled liquid region. The alloy subjected to the same thermal history without such working is markedly embrittled in spite of its amorphousness. Although the cause of the above phenomena is not yet elucidated, it is attributable to the effect of suppressing the structural relaxation (structural change into a more stable atomic arrangement in an amorphous state), which is caused by heating, by giving a strain to the alloy.

The effects of the rate and amount of strain on the above-mentioned suppression effect vary depending on the alloy but can be generally expressed by the range of the supercooled liquid region. Typically, an amount of strain of 30% or more with a strain rate of $1\times10^{-3}$/sec or higher is applied to an alloy having a range of supercooled liquid region of about 100K, an amount of strain of 50% or more with a strain rate of $2\times10^{-3}$/sec or higher is applied to an alloy with a supercooled liquid region about 80K and an amount of strain of 50%. or more with a strain rate of $3\times10^{-3}$/sec or higher is applied to an alloy with a supercooled liquid region of about 60K. The strain rate is correlated with the amount of strain and even a low strain rate can achieve the purpose with a large amount of strain. The aforesaid effect can be utilized for the consolidation forming of various powders and thin ribbons and the shaping of an amorphous bulk material such as casting. At any rate, a notable feature of the process according to the present invention resides in that the process facilitates the simplification of the working steps and temperature control inevitable for the working of an amorphous alloy material without restriction to the cooling rate after working.

The process of the present invention is applicable to an amorphous alloy having a supercooled liquid region other than the aforestated alloys.

EXAMPLE $La_{55}Al_{25}Ni_{20}$ (wherein each subscript represents the atomic percentage of the element) alloy was made into a test piece in the form of a ribbon with 0.05 mm thickness and 1.5 mm width by melt spinning.

The test piece was proven to be an amorphous alloy having a broad diffraction pattern peculiar to amorphousness by the result of analysis on an X-ray diffraction apparatus. The result of analysis of the test piece by differential scanning calorimetry at a heating rate of 40° C./min gave a glass transition temperature of 476K and a crystallization temperature of 545K. The test piece was held at various temperatures for 1800 seconds to measure the ductility (brittleness), which was evaluated by bending the test piece in the longitudinal direction, sandwiching it between two parallel flat plates, gradually bringing the two plates close to each other until both ends of the bent test piece are brought into close contact with each other, and observing when the test piece is fractured. The flexural strain at the point of fracture was expressed by the formula $$Ef=t/(L-t)$$

where

Ef: flexural strain t: thickness of ribbon

L: distance between flat plates

The results are given in FIG. 1 (by way of reference) as a function of the annealing temperature. An Ef value of 1 is obtained when the test piece will not be fractured even when bent at an angle of 180 degrees, showing ductility and an Ef value of less than 1 indicates embrittlement. As seen from the above figure, the test piece is suddenly embrittled at 416K and shows an approximately constant Ef value of 0.03 at an annealing temperature of 434K and higher, indicating a harmful structural relaxation caused at 416K.

Figure 2:
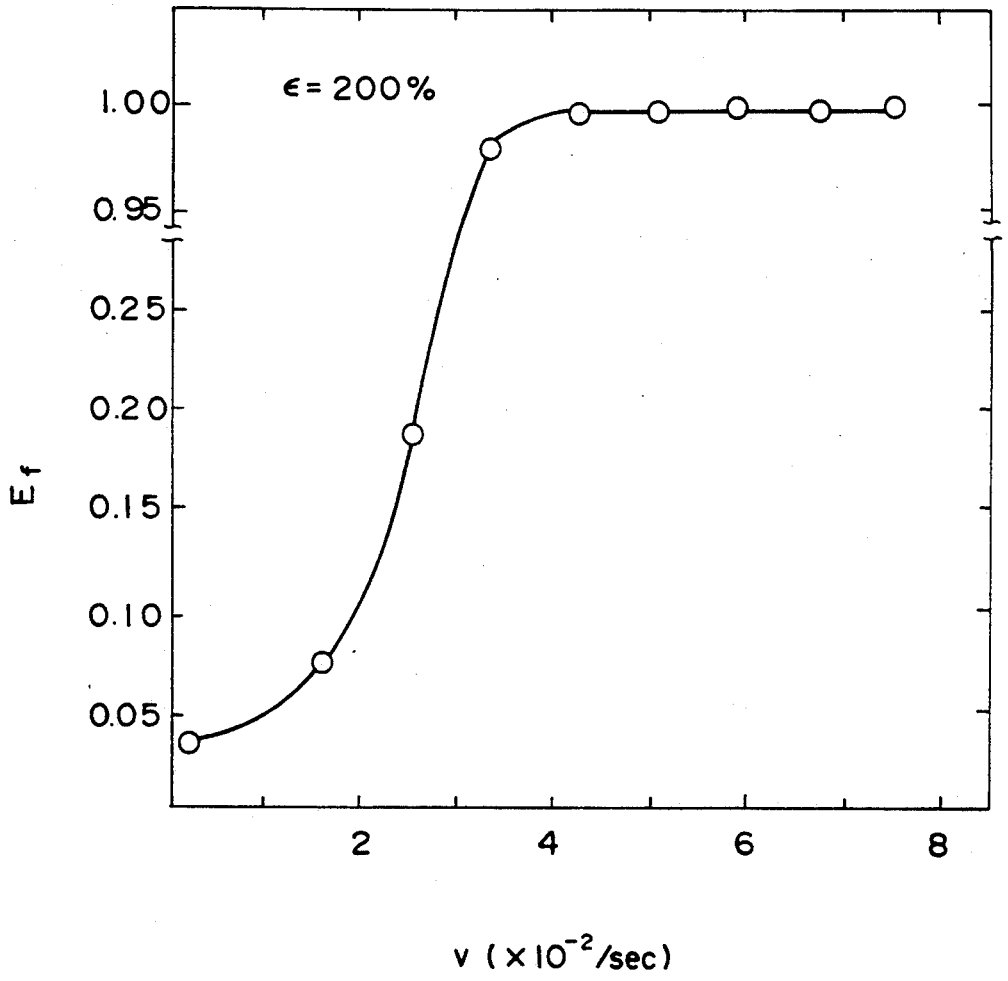
FIG. 2 is a graph showing the measurement results for the ductility of the amorphous ribbon in FIG. 1 after being given a prescribed amount of strain.

The untreated ribbon was heated to a temperature of 500K in the supercooled liquid region, held thereat for 180 seconds, then subjected to tensile deformation up to an amount of strain of 200% at various strain rates, allowed to spontaneously cool in a furnace (5K/min) and tested for ductility in the same manner as the above one. The results are given in FIG. 2. As seen from this figure, the value of Ef exhibits a sudden rise at a strain rate of $2\times1^{-2}$/sec, reaches 1 at $4\times10^{-2}$/sec, proving that ductility is maintained by the application of work strain. For reference, all the non-deformed parts of the test piece had an Ef value of 0.02 or less. The result of analysis for the test piece subjected to work strain on an X-ray diffraction apparatus showed a halo pattern peculiar to amorphousness.

It has been confirmed by the above example that the application of work strain at a temperature in the supercooled liquid region of the amorphous alloy can eliminate the possibility of embrittlement of the alloy due to structural relaxation, even if the worked alloy was gradually cooled, and thereby produce the amorphous alloy material excellent in ductility. The above-mentioned effect is embodied in other Al-TM-Ln, Mg-TM-Ln, Zr-T-Al and Hf-TM-Al alloys as well.

The present invention can provide an amorphous alloy material excellent in strength, ductility and hot plastic workability without the loss of ductility due to structural relaxation caused by thermal history in the consolidation forming or other plastic working at a high temperature of the amorphous alloy obtained as various powders or thin strips.

We claim:

1. A process for producing an amorphous alloy material which comprises imparting ductility to an amorphous alloy having a supercooled liquid region by giving an amount of strain of 30% or greater at a strain rate of $1\times10^{-3}$/sec or higher to said alloy in the glass transition temperature region of said alloy.

2. A process for producing an amorphous alloy material which comprises producing a ductile consolidated shape formed by giving an amount of strain of 30% or greater at a strain rate of $1\times10^{-3}$/sec or higher to an amorphous alloy having a supercooling liquid region, in the form of spherical or irregular shaped powder or thin ribbon, while conducting pressing in the glass transition temperature region of said alloy.

3. A process for producing an amorphous alloy material which comprises producing an amorphous intermediate raw material or final product each having a required shape and ductility by giving an amount of strain of 30% or greater at a strain rate of $1\times10^{-3}$/sec or higher to an amorphous alloy having a supercooled liquid region in the form of casting or primary consolidated material of powder or thin ribbon, while conducting pressing in the glass transition temperature region of said alloy.

4. The process according to claim 1 wherein said prescribed strain rate is $2\times10^{-2}$/sec or higher.

5. The process according to claim 2 wherein said prescribed strain rate is $2\times10^{-2}$/sec or higher.

6. The process according to claim 3 wherein said prescribed strain rate is $2\times10^{-2}$/sec or higher.

7. The process according to claim 1 wherein said prescribed amount of strain is 50% or greater.

8. The process according to claim 2 wherein said prescribed amount of strain is 50% or greater.

9. The process according to claim 3 wherein said prescribed amount of strain is 50% or greater.

10. The process according to claim 1 which is further followed by the step of allowing said alloy material to cool in a furnace or spontaneously.

11. The process according to claim 2 which is further followed by the step of allowing said alloy material to cool in a furnace or spontaneously.

12. The process according to claim 3 which is further followed by the step of allowing said alloy material to cool in a furnace or spontaneously.

13. The process according to claim 10 wherein said alloy material is allowed to cool in a furnace or spontaneously at a cooling rate of 5° C./min or higher.

14. The process according to claim 11 wherein said alloy material is allowed to cool in a furnace or spontaneously at a cooling rate of 5° C./min or higher.

15. The process according to claim 12 wherein said alloy material is allowed to cool in a furnace or spontaneously at a cooling rate of 5° C./min or higher.

16. The process according to claim 1 wherein said amorphous alloy is an Al-TM-Ln, Mg-TM-Ln, Zr-Tm-Al or Hf-TM-Al alloy, wherein TM is a transition metal element and Ln is a rare earth metal element.

17. The process according to claim 2 wherein said amorphous alloy is an Al-TM-Ln, Mg-TM-Ln, Zr-TM-Al or Hf-TM-Al alloy, wherein TM is a transition metal element and Ln is a rare earth metal element.

18. The process according to claim 3 wherein said amorphous alloy is an Al-TM-Ln, Mg-TM-Ln, Zr-TM-Al or Hf-TM-Al alloy, wherein TM is a transition metal element and Ln is a rare earth metal element.

* * * * *